US005794638A

United States Patent [19]

Richey et al.

[11] Patent Number: 5,794,638

[45] Date of Patent: Aug. 18, 1998

[54] COMPOSITE BASE ASSEMBLY FOR CANE HAVING FIFTH LEG

[75] Inventors: Joseph B. Richey, Chagrin Falls; Shane Obitts, Elyria, both of Ohio

[73] Assignee: Invacare Corporation, Elyria, Ohio

[21] Appl. No.: 743,757

[22] Filed: Nov. 7, 1996

[51] Int. Cl.[6] ..... A45B 9/04

[52] U.S. Cl. ..... 135/65; 135/67; 135/77; 135/82; 135/86

[58] Field of Search ..... D3/3, 17; 135/65, 135/67, 68, 77, 911, 78, 79, 80, 81, 82, 86

[56] References Cited

U.S. PATENT DOCUMENTS

| | | | |
|---|---|---|---|
| D. 324,946 | 3/1992 | Karten . | |
| 3,163,437 | 12/1964 | Phillipson | 135/77 X |
| 3,289,685 | 12/1966 | Parker | 135/77 X |
| 4,274,430 | 6/1981 | Schaaf et al. | 135/65 |
| 4,510,957 | 4/1985 | Frank | 135/86 X |
| 4,601,302 | 7/1986 | Breen et al. | 135/78 X |
| 4,947,882 | 8/1990 | Levasseur | 135/77 X |
| 4,997,001 | 3/1991 | DiCarlo | 135/77 X |
| 5,238,013 | 8/1993 | Battiston et al. | 135/77 X |
| 5,390,687 | 2/1995 | Tsai | 135/77 X |
| 5,499,645 | 3/1996 | Baliga | 135/77 X |

FOREIGN PATENT DOCUMENTS

| | | | |
|---|---|---|---|
| 1181795 | 2/1970 | United Kingdom | 135/77 |

OTHER PUBLICATIONS

"New Canes & Crutches" Catalog.

*Primary Examiner*—Wynn Wood Coggins
*Attorney, Agent, or Firm*—Fay, Sharpe, Beall, Fagan, Minnich & McKee

[57] ABSTRACT

A patient support device, particularly a cane, includes a fifth leg that extends outwardly from a central portion of a base assembly at a region intermediate the first, second, third, and fourth legs. The fifth leg provides increased balance and stability for the user. Moreover, the base assembly includes a one-piece member constructed from a molded plastic composite material to reduce manufacturing costs. Additionally, the fifth leg is slightly recessed relative to the remaining four legs so that the patient's weight is evenly distributed to the perimeter of the support area defined by the base member.

12 Claims, 2 Drawing Sheets

COMPOSITE BASE ASSEMBLY FOR CANE HAVING FIFTH LEG

BACKGROUND OF THE INVENTION

This invention pertains to the art of durable medical health products and, more particularly, to patient support devices. The invention is particularly applicable to a cane and improvements upon what is referred to in the industry as a quad cane.

A quad cane includes four legs spaced about the perimeter of an enlarged base member received on a lower end of the cane. Whereas a standard cane has a single tip or leg for engaging the floor or ground surface, a quad cane is designed to provide a wider area of contact via the four legs contacting spaced apart points of the floor. Each leg typically includes a rubber tip that enhances gripping contact with the floor, as well as serving the additional purpose of absorbing shock.

Prior art quad cane constructions are usually an assembly in which a support tube has a metal plate secured (welded) at one end thereof and in a generally perpendicular relation to a longitudinal axis of the cane. Secured to the plate, again typically by a brazing or welding operation, are a pair of generally symmetrically arranged leg assemblies. Each leg assembly includes two downwardly extending legs for engaging the ground. The support tube, plate, and leg assemblies are usually formed from a chrome-plated steel.

Although the base assembly of quad canes do provide a larger region of contact with the floor adding lateral stability and balance for the cane user, a number of areas have been targeted for improvement. First, additional stability is desired. In the prior art constructions, the legs are spaced about the perimeter of the base assembly as described above. Although this perimeter spacing provides increased balance and lateral stability, an enlarged region or open area generally centrally disposed between the four legs has no support leg or support surface. Thus, for example, if a user is climbing stairs, and only two or three of the legs engage the step, the desired balance and increased stability features may not be provided.

Second, although the welded assembly has been a commercially successful product, it is rather labor-intensive to manufacture. A larger inventory of parts is required. For example, a stem tube, a plate, a pair of legs, and separate rubber tips are required to be assembled together to form the quad base. More particularly, the stem tube, plate, and legs are secured together in a labor-intensive welding operation, the metal assembly then typically chrome plated, and then the rubber tips mounted on terminal ends of the legs.

Accordingly, in an effort to provide further stability and decrease manufacturing costs, the subject invention was developed.

SUMMARY OF THE INVENTION

The present invention provides a new and improved base assembly for a cane that overcomes the above-described problems and others, and provides a durable, stable, and economical base assembly for a cane.

According to the present invention, a fifth leg extends outwardly from the base at an area generally centrally disposed between four perimeter positioned legs.

According to a more limited aspect of the invention, the fifth leg extends outwardly from the base member a dimension slightly less than the remaining legs.

According to another aspect of the invention, the base member is formed as a one-piece, molded plastic.

A principal advantage of the invention is increasing the stability and balance of the cane.

Another advantage of the invention resides in the decreased cost of manufacture while providing all of the features and benefits of predecessor quad canes.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
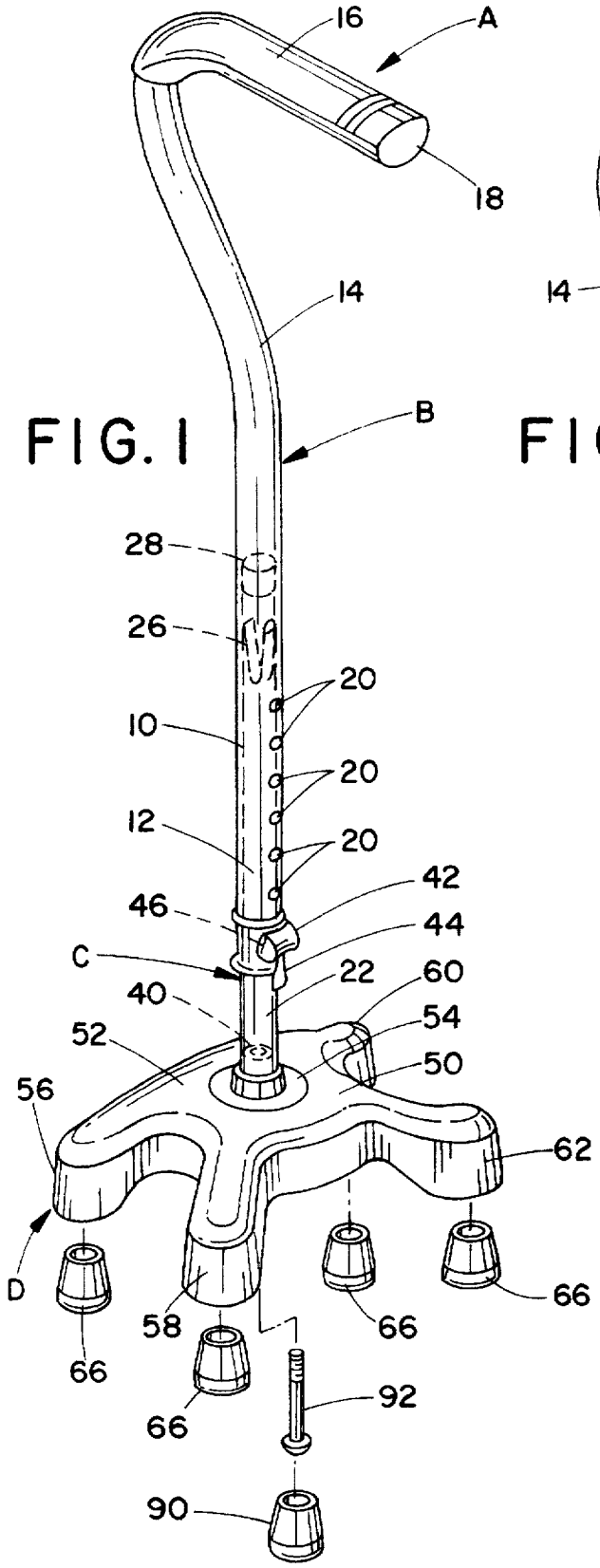
FIG. 1 is a perspective view of a cane formed in accordance with the subject invention.

Referring now to the drawings wherein the showings are for the purposes of illustrating the preferred embodiment of the invention only and not for purposes of limiting same, the FIGURES show a composite cane A generally comprised of a handle B, a stem tube C, and a base assembly D. More particularly, and turning to FIG. 1, the handle B of the cane includes an elongated, tubular member 10 which is preferably a hollow aluminum tube that is open at a first or lower end 12. The handle is offset as defined by bent region 14 that merges into a horizontal second or upper end 16. A hand grip 18 is preferably received over the second end for comfortable, secure gripping by the user.

Figure 2:
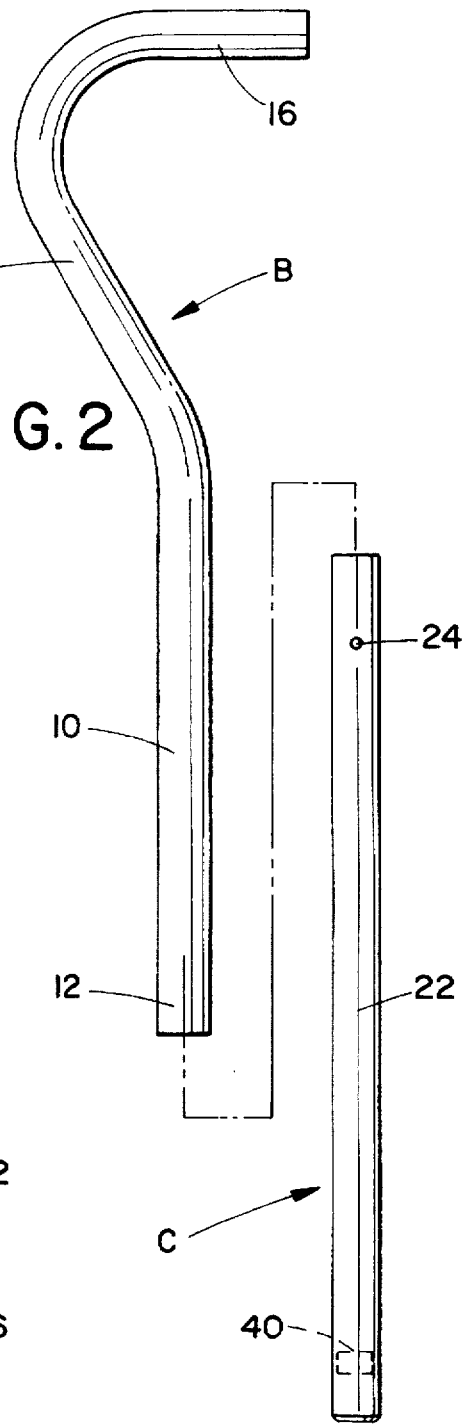
FIG. 2 is an exploded view of the cane handle and stem tube, particularly illustrating height adjustment features thereof.

A series of axially spaced openings 20 are provided along the lower end 12 of the tube. The openings are preferably defined along diametrically opposite regions of the tube lower end. The openings define one component of a height adjustment feature so that the cane can be extended or retracted to accommodate users of different heights. Although generally well known in the art, more particular details of the height adjustment structure and operation will be described below. As shown in FIG. 2, the open end 12 of the handle receives a stem member 22, which is also preferably of hollow tubular construction. The stem member is dimensioned for axial sliding receipt within the inner diameter of the tube 10. The stem member further includes at least one opening 24, and preferably a pair of openings, that receives a snap button assembly 26. The snap button assembly is of conventional arrangement and includes a pair of snap buttons that protrude through the openings 24. When the diametrically opposed openings 20 in the tube 10 are aligned over the snap buttons, the snap buttons are spring biased outwardly through the openings 20 to axially lock the tubes 10, 22 against relative axial movement. By selectively depressing both snap buttons inwardly through the openings 20, the relative axial position between the tubes can be adjusted and the height of the cane altered to the desired length.

A plug 28 is preferably received in the upper end of stem member 22 and provides a tight fit relation with the inner diameter of tube 10 to eliminate rattle and play therebetween. A connector 40 is received in the second end of the stem member. The connector has a barbed exterior that grippingly engages the internal diameter of the stem member and is used for securing the stem member to the base assembly. Additionally, a cam lock collar 42 is disposed about the lower end of tube 10 and cooperates with the outer surface of the stem member 22. A lever 44 is pivotally mounted to the collar and has a cam surface 46 at its interior end that grippingly engages the external surface of the stem member when the lever is moved to an actuated position. This cam arrangement provides for ease of adjustment and also eliminates play and rattle between the cooperating tubular members 10, 22.

Figure 4:
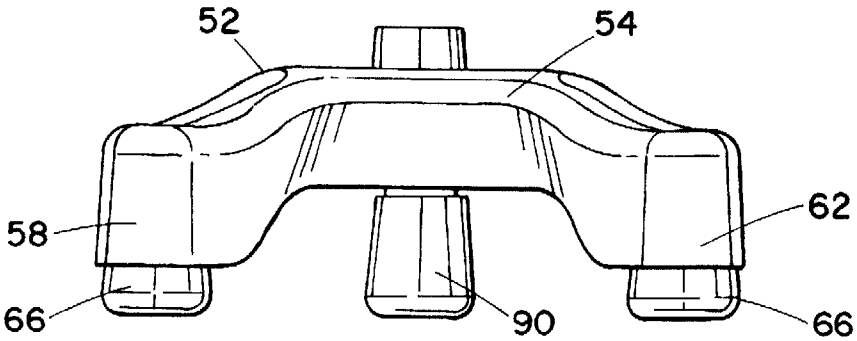
FIG. 4 is a front elevational view of the base assembly.

With continued reference to FIG. 1, and additional reference to FIGS. 3–6, the base assembly is illustrated in greater detail. It includes a composite molded base 50 having a generally smooth, continuous upper surface 52. An enlarged central portion 54 has four legs 56, 58, 60, 62 extending outwardly therefrom. The first and second legs 56, 58 define one pair that is symmetrically disposed relative to a second leg pair comprised of the third and fourth legs 60, 62. Each of the legs is located adjacent the outer perimeter of the base member to provide an enlarged area of contact between the base and the ground surface, in much the same manner as a typical quad cane base. Thus, each leg is located not only generally radially outward from the central portion 54, but also extends downwardly therefrom (FIG. 4). This provides a generally arched configuration that stable, well balanced, and provides increased lateral stability.

Each of the legs includes a rubber tip 66 that is adapted to provide a secure grip with the ground surface and cushion the cane against shock. Preferably, each rubber tip is frictionally received over a cylindrical post 68 (FIGS. 5 and 6) defined in each leg. The tips are press-fit over the posts and a perimeter wall 70 encases a substantial peripheral portion of the sidewall of each rubber tip.

Figure 5:
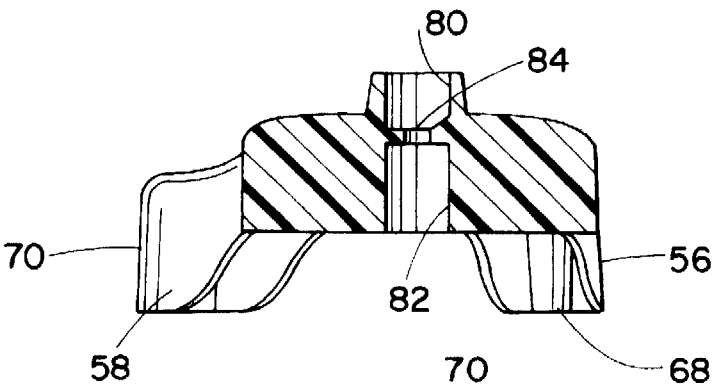
FIG. 5 is a side elevational view with selected portions in ross-section of the base assembly.
Figure 6:
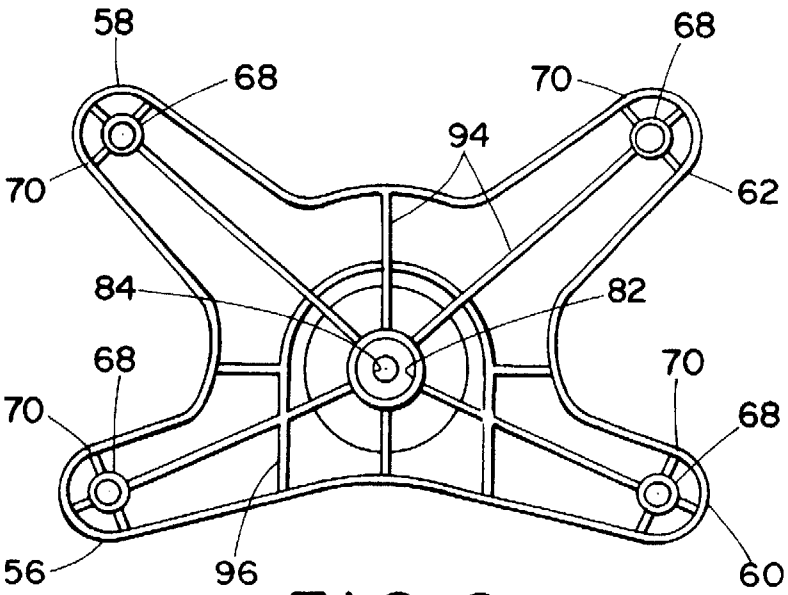
FIG. 6 is a bottom plan view of the base assembly.
Figure 3:
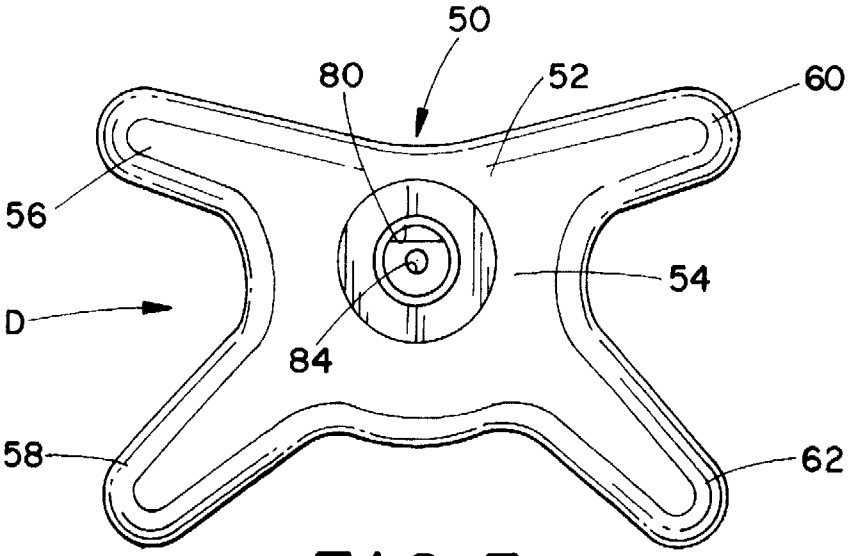
FIG. 3 is an overhead plan view of the new base assembly.

FIG. 5 best illustrates the interconnection of the base assembly to the stem member. In the preferred arrangement, a pair of oppositely disposed, generally cylindrical recesses 80, 82 are interconnected by a smaller diameter opening 84. The first or upper recess 80 is dimensioned to receive the lower end of the stem member 22. Similarly, the second or lower recess 82 is adapted to receive a fifth leg or rubber tip 90. A fastener such as screw 92 is received through the fifth tip 90, proceeds upwardly through the opening 84, and is of sufficient length for threaded engagement with the tube connector 40 in the stem member. In this manner, the stem member and fifth tip are secured to the base member 50 via a single fastener.

The fifth leg is generally centrally disposed between the first, second, third, and fourth legs. It is preferably located along the axis of symmetry between the leg pairs and its central mounting provides for additional stability and balance in instances where only a few of the legs adequately engage the floor. For example, if only a pair of the legs engage the flight of a step, an undesired tipping action could occur until the plate in prior art constructions engages the edge of the step. With the preferred embodiment of the subject invention, however, the fifth leg will provide the additional support, balance, and stability by contacting the step surface. The problems associated with an enlarged central region having no support leg or support surface is overcome.

With continued reference to FIG. 5, the fifth leg extends outwardly from the base member a dimension slightly less than the remaining four legs. Although all five legs could be disposed at the same level, it is preferred to slightly recess the fifth leg. In this way, the fifth leg still provides the desired support and stability for situations as described above, and also does not interfere with the desired transmission of forces to the four peripherally spaced legs.

A series of strengthening ribs 94 are provided in the generally hollow base member. The ribs include four radially directed or spoke-like portions extending from the central portion about the recess to each of the posts 68 associated with the first, second, third, and fourth legs. Additionally, a generally U-shaped rib 96 provides additional strength and rigidity about the central portion of the base member. The rib array increases the strength of the assembly while minimizing the amount of composite plastic material used to mold the base member. In the preferred embodiment, a glass filled nylon is used as the preferred material of construction, although it is understood that still other materials could be used with equal success.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. In a patient support device having a handle conformed to receive weight from a patient.; an stem member operatively associated with the handle, and having first and second ends, the first end receiving the patient's weight from the surface for transfer to the second end; a base assembly operatively associated with the second end of the stem member and including first, second, third, and fourth legs extending outwardly therefrom for transferring the patient's weight from the stem member to an associated ground surface, the improvement comprising:

a fifth leg extending outwardly from the base member in a region intermediate the first, second, third, and fourth legs, each of the first, second, third, fourth and fifth legs includes a non-slip tip on the terminal end of the legs adapted to engage the ground surface, the tip of the fifth lea being disposed on an external surface of the base member.

2. The patient support device as defined in claim 1 wherein the first, second, third, and fourth legs are disposed about the perimeter of the base assembly.

3. The patient support device as defined in claim 1 wherein the fifth leg is generally centrally disposed among the first, second, third, and fourth legs.

4. The patient support device as defined in claim 1 wherein the fifth leg extends outwardly from the base member a dimension less than the first, second, third, and fourth legs.

5. The patient support device as defined in claim 1 wherein the base member is formed from a one-piece plastic material.

6. The patient support device as defined in claim 1 wherein the first, second, third, and fourth legs are symmetrically spaced about an axis in first and second pairs about the periphery of the base member and the fifth leg is substantially located on the axis of symmetry.

7. A cane for supporting a patient comprising:

a stem having a handle at one end for gripping by a patient; and a base member secured to a second end of the stem, the base member including first, second, third, and fourth peripherally spaced legs extending outwardly therefrom, and a fifth leg substantially centrally disposed between the other legs and extending outwardly from an external surface of the base member in the same direction as the other legs, wherein the each of the legs includes a rubber tip for engaging the ground surface.

8. The cane as defined in claim 7 wherein the fifth leg extends outwardly from the base member a dimension less than the other legs.

9. The cane as defined in claim 7 wherein the base member is constructed from a plastic material.

10. The cane as defined in claim 7 wherein the fifth leg extends outwardly from the base member in an opposite direction than the stem member.

11. The cane as defined in claim 10 wherein the fifth leg is directly connected to the stem member.

12. The cane as defined in claim 11 wherein the stem member is a two-part construction that allows the height of the cane to be selectively adjusted.

* * * * *